US008450950B2

(12) United States Patent
McRae

(10) Patent No.: US 8,450,950 B2
(45) Date of Patent: May 28, 2013

(54) APPARATUS AND METHOD FOR CONTROLLING LED LIGHT STRINGS

(75) Inventor: Michael M. McRae, Ormond Beach, FL (US)

(73) Assignee: National Christmas Products, Inc., Crawford, NJ (US)

( * ) Notice: Subject to any disclaimer, the term of this patent is extended or adjusted under 35 U.S.C. 154(b) by 241 days.

(21) Appl. No.: 12/930,892

(22) Filed: Jan. 19, 2011

(65) Prior Publication Data

US 2011/0241551 A1 Oct. 6, 2011

Related U.S. Application Data

(60) Provisional application No. 61/296,258, filed on Jan. 19, 2010, provisional application No. 61/460,048, filed on Dec. 23, 2010.

(51) Int. Cl.
*H05B 37/00* (2006.01)

(52) U.S. Cl.
USPC ..... 315/318; 315/320; 315/312; 315/185 R; 315/185 S; 315/207; 362/249.06; 362/249.14

(58) Field of Classification Search
USPC ..... 315/130, 160, 185 R, 185 S, 192, 315/193, 291, 297, 307, 312, 318, 320, 207; 362/249.06, 249.14, 249.12, 249.19, 659, 362/800
See application file for complete search history.

(56) References Cited

U.S. PATENT DOCUMENTS

| | | | | |
|---|---|---|---|---|
| 6,461,019 | B1 * | 10/2002 | Allen | 362/249.06 |
| 8,305,008 | B2 * | 11/2012 | Yang | 315/291 |
| 2006/0180822 | A1 * | 8/2006 | Yu | 257/98 |
| 2008/0116816 | A1 * | 5/2008 | Neuman et al. | 315/185 S |
| 2009/0189533 | A1 * | 7/2009 | Hsu | 315/185 S |
| 2010/0141161 | A1 * | 6/2010 | Hering et al. | 315/185 S |

* cited by examiner

*Primary Examiner* — Haiss Philogene
(74) *Attorney, Agent, or Firm* — Brian K. Johnson, Esq., LLC

(57) ABSTRACT

An enhanced control mechanism for an LED light string system is provided for switching between one of two DC output phases or polarities so as to actuate one or the other of two LEDs within the bulbs on the light string. The control mechanism is further configured to allow switching so as to pass through the input power provided by a light string that is plugged into its electrical power feeding end. The control mechanism may provide either AC, rectified AC, or DC voltage of various values to the LED string according to the particular needs of the LED bulbs.

11 Claims, 6 Drawing Sheets

APPARATUS AND METHOD FOR CONTROLLING LED LIGHT STRINGS

RELATED APPLICATIONS

This application claims priority to the U.S. Provisional Patent Application Ser. No. 61/296,258, titled "Adapter for Coordinating Illumination of Multi-Color LED Lighting String Displays", filed on Jan. 19, 2010; and the U.S. Provisional Patent Application Ser. No. 61/460,048, titled "Apparatus and Method for LED Light String Connection", filed on Dec. 23, 2010, the contents of all of which are herein incorporated by reference in their entirety.

FIELD OF THE INVENTION

The disclosure relates generally to a multi-color light emitting diode (LED) light string and more specifically, to a controller for coordinating the illumination of the different color LED lights; the lights being contained within a single light string or among several interconnected LED light strings.

BACKGROUND OF THE INVENTION

Various LED light strings have been proposed for decorative illumination purposes. U.S. Pat. Appln. Pub. No. US2009/0189533 (Hsu), for example, discloses an LED-based light string formed with multiple, dual colored LED lamps and a controller for coupling the LED light string to the power supply. According to one preferred embodiment in Hsu, FIG. 4 discloses a light string in which two LED lamps of different colors are set within a single body. The body is shown to have two connection leads, and the two LED lamps are electrically connected within the body such that one LED lamp illuminates when a positive DC voltage is applied to the two leads of the body and the other LED lamp illuminates when a negative DC voltage is applied to the two leads of the body. Multiple bodies are then electrically connected in series so as to create a single string of LED lights. Claim 3 of Hsu further states that the controller can control only one or the other of the two LEDs within the body to emit a single color, or can control both alternately to emit both colors. However, Hsu does not disclose any structure or mechanisms for accomplishing these control functions.

Other arrangements of the LEDs within light strings are also known. U.S. Pat. No. 6,461,019 (Allen) discloses a LED light string in which a plurality of LEDs are wired in block series-parallel where one or more series blocks are each driven at the same input voltage as the source voltage and the series blocks are coupled in parallel. Allen also mentions that the individual LEDs of the light string may be arranged continuously (using the same color) periodically (using multiple, alternating CIP colors), or pseudo-randomly (any order of multiple colors). However, Allen does not provide for any control functions regarding the illumination of different colored LED within those arrangements.

Thus the need exists to provide for a LED light string controller that is capable of controlling and coordinating the specific illumination of the LEDs within the string, particularly with respect to the control of color. Further, one master LED light controller would ideally provide such control functions in an arrangement containing multiple LED light strings, while the controllers for the other light strings followed or mirrored the color selection made by master controller.

SUMMARY OF THE INVENTION

According to one particularly preferred embodiment of the invention a lighting system is provided comprising a light string, the light string having bulbs containing a first color LED and a second color LED, the LEDs within the bulbs electrically coupled so that a first voltage phase applied to the light string provides a turn-on bias to the first color LEDs within the bulbs and a second voltage phase applied to the light string provides a turn-on bias to the second color LEDs within the bulbs; and a controller electrically coupled to one end of the a light string, the controller having a rectifier for accepting an input electrical power source and providing an output DC electrical power to the light string, the controller having a switch with a plurality of switch positions including: a first switch position for providing the output DC electrical power to the light string in the first voltage phase according to a first rectification provided by the rectifier within the controller, a second switch position for providing the output DC electrical power to the light string in the second voltage phase according to a second rectification provided by the rectifier within the controller, and a third switch position for providing the input electrical power source directly to the output DC electrical power and on to the light string.

According to other aspects of the lighting system, the controller includes a fourth switch position that provides no output DC electrical power to the light string; or the rectifier is a low voltage AC-to-DC converter; or the rectifier is a full-wave bridge rectifier; or the input electrical power source is a DC power source; or a socket is connected to another end of the light string; the controller and the socket having indicators for identifying a polarity of the LED light string; or the lighting system includes a plurality of the light strings and coupled controllers; only one of the controllers having the switch in either of the first or the second switch positions; the other controllers having the switch in the third switch position.

In another preferred embodiment of the invention, a controller is provided for controlling a LED light string, the controller comprising a rectifier for accepting an input electrical power source and providing an output DC electrical power to the LED light string, the controller having a switch with a plurality of switch positions including: a first switch position for providing the output DC electrical power to the LED light string in a first voltage phase according to a first rectification provided by the rectifier within the controller, a second switch position for providing the output DC electrical power to the LED light string in a second voltage phase according to a second rectification provided by the rectifier within the controller, and a third switch position for providing the input electrical power source directly to the output DC electrical power and on to the LED light string. In one aspect of this embodiment, the controller includes a standardized plug end for connection to the LED light string, the standardized plug end having only one coupling orientation.

In a preferred method according to the invention, a method of providing switched control to a lighting system is provided comprising: coupling a first and second controller to a first and second LED light string respectively, coupling the second controller to the first LED light string so that input power to the second controller is provided by the first LED light string; switching the first controller to provide DC rectified power at a power output of the first light string, the DC rectified power derived from an input power source to the first controller and provided as the input power to the second controller; and switching the second controller to a pass through mode wherein the DC rectified power is provided directly to the second LED light string. In one aspect of this method, the steps include coupling a third controller to a third LED light string; coupling the third controller to the second LED light string so that input power to the third controller is provided by the second LED light string; and switching the third controller to a pass through mode wherein the DC rectified power output of the second light string is provided directly to the third LED light string.

BRIEF DESCRIPTION OF THE DRAWINGS

The accompanying drawings, which are incorporated in and constitute part of this specification, illustrate embodiments of the invention and together with the description, serve to explain the principles of the invention. Like references indicate similar elements among the figures and such elements are illustrated for simplicity and clarity and have not necessarily been drawn to scale. The embodiments illustrated herein are presently preferred, it being understood, however, that the invention is not limited to the precise arrangements and instrumentalities shown, wherein.

DETAILED DESCRIPTION OF THE INVENTION

It is often desirable to have multiple LED light strings connected together for use as a lighting display or as part of such a display, such as on a Christmas tree or holiday decoration. In many displays it is also desirable for a lighting string to display a first color (e.g. clear or white) and then discontinue that displayed color in favor of a second color (e.g. blue or a plurality of other colors). In the case of color coordination and switching, it is also desirable to effect such changes easily and in a relatively simple manner. Specifically, the use of a single control point is desirable in larger lighted displays where multiple LED light strings are connected together and color change is to be effected among all such interconnected strings.

Figure 1:
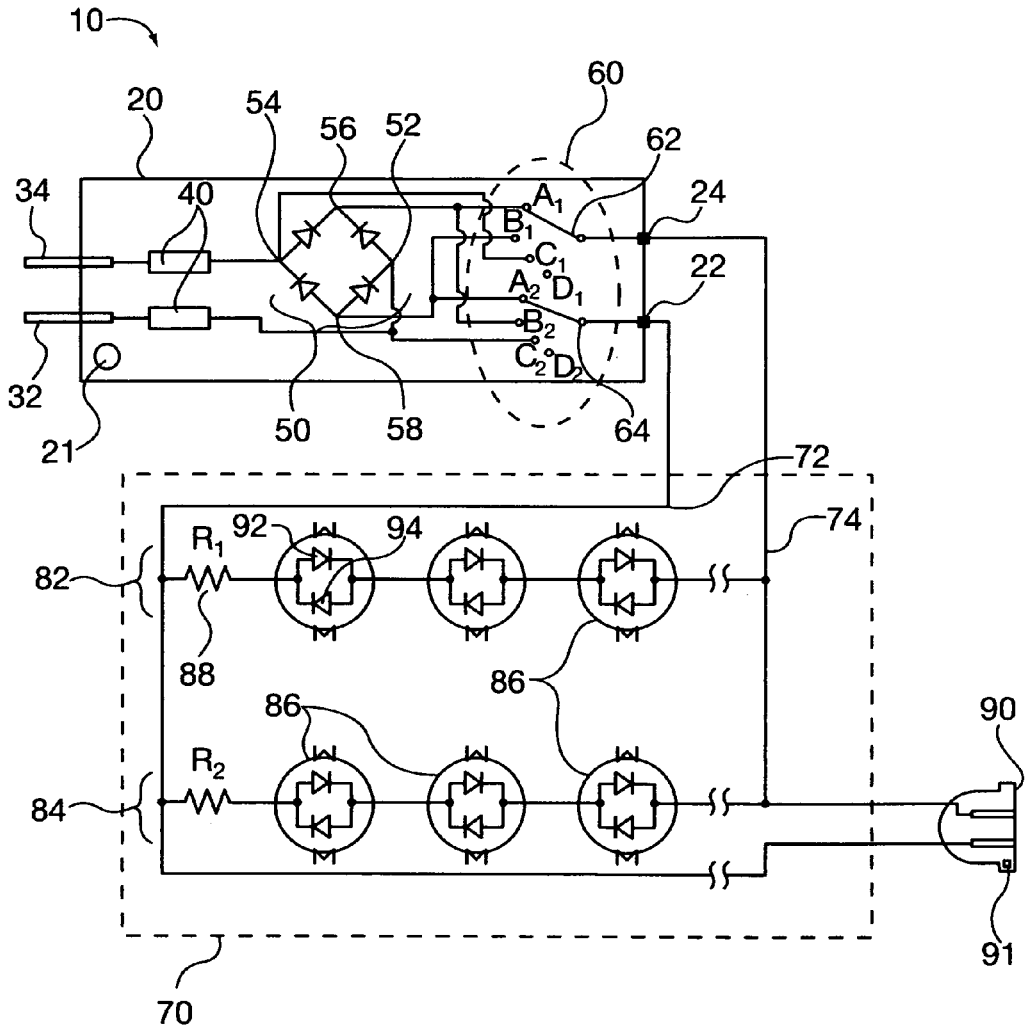
FIG. 1 is a circuit diagram of an LED light string system according to one embodiment of the present invention.

With reference to FIG. 1, a LED light string system 10 is provided containing a controller 20 and a plurality of LED light strings 70. The light string(s) 70 may be organized in any feasible arrangement given the power supply capabilities of the controller 20. As shown in FIG. 1, two blocks of series connected LEDs 82 and 84 are wired in parallel between electrical connectors 72 and 74. As shown, each block of series connected LEDs contains a plurality of bulbs 86 each containing two LEDs 92 and 94 of two different colors. By way of the example shown in FIG. 1, the "W" and "M" designations next to the LEDs in the bulbs refer to "white" (clear) and "multi-colored" (e.g. blue) respectively. Resistor 88 is optionally included in each series block to provide a current limiting function within the series. Within each bulb, LEDs 92 and 94 are electrically connected to one another anode-to-cathode and cathode-to-anode such that a DC bias voltage applied across connectors 72 and 74 will turn on only one of the LEDs within each bulb. Further, the light string series are arranged such that a DC bias voltage applied across connectors 72 and 74 will turn on simultaneously all the similarly colored LEDs within each light string (i.e. either all white LEDs in the each light string or all colored LEDs in each light string). Connectors 72 and 74 are terminated at female plug end 90.

Controller 20 is electrically coupled to connectors 72 and 74 at connection points 22 and 24 respectively. Controller 20 has male plug leads 32 and 34 for plugging into a standard 115V AC receptacle or into the female plug end of another LED light string system. Fuses 40 are provided in series with associated electrical connectors coupled to male plug leads 32 and 34 which are then connected to a rectifier 50 at rectifier terminals 52 and 54 respectively. Four-position switch 60 is connected at one side to rectifier terminals 52, 54, 56 and 58 as shown and as further described below. Four-position switch 60 is connected at the other side to connectors 72 and 74 at connection points 22 and 24 respectively.

As shown, and strictly by way of example, rectifier 50 is a full-wave bridge rectifier having rectifier terminals 52, 54, 56 and 58. Although the operation of full-wave bridge rectifiers is well known to those of skill in the art, a brief description follows. In practice, almost any rectifier (e.g. full-wave, half-wave) or other AC/DC converter can be used operate in circuit position 50 so as to provide a single phase DC voltage at rectifier connection points 56 and 58. The term rectifier is used herein to denote any such device, without limitation, that provides such a function. In operation, an input AC voltage is applied across full-wave bridge rectifier terminals 52 and 54. During one half of the AC power cycle the two diodes on the left-hand side of the bridge are forward biased and the two diodes on the right-hand side of the bridge are reverse biased thereby making a half wave rectification (having a DC component in one phase) available at rectifier terminals 56 and 58. During the other half of AC power cycle the two diodes on the right-hand side of the bridge are forward biased and the two diodes on the left-hand side of the bridge are reverse biased thereby making another half wave rectification (having a DC power component in the same one phase) also available at rectifier terminals 56 and 58. It should be noted that if the output connection to rectifier terminals 56 and 58 is reversed, full wave rectification (the sum of the two half wave rectifications described above) would be provided in the second (other) phase such that the DC power component has an opposite polarity of that of the first phase.

Four-position switch 60 may be any type of electrical switch capable of making four different connections on the input (switched) side and providing the switched output at connection points 22 and 24. For example, rotary switches, four-position slide switches multiple-push, cycling button switches may all be used for such purposes. As indicated in FIG. 1, the four-position switch has two inputs as provided at terminals 62 and 64 from one of four labeled switch positions A, B, C, D. In switch position A (both switch levers—as shown by dashed lines), rectifier terminals 56 and 58 are connected to the switch output and connection points 24 and 22 respectively. In switch position B (both switch levers), the rectifier terminals are reversed and rectifier terminals 56 and 58 are connected to the switch output and connection points 22 and 24 respectively. In switch position C (both switch levers), the rectifier terminals are bypassed entirely and the switch output and connection points 22 and 24 are connected directly to the power input provided to male plug leads 32 and 34 respectively. In switch position D (both switch levers), no connection to a power input is provided and connection points 22 and 24 remain unpowered and electrically disconnected.

In operation, AC electrical power is provided at male plug leads 32 and 34. With the switch positioned at A, full wave rectification is provided at rectifier terminals 56 and 58 in a first phase (polarity) and passed on to connection points 22 and 24. The first phase DC voltage is conducted through the LED light string coupled across connectors 72 and 74 and all of the positively biased LEDs within each of the bulbs are illuminated. If the LEDs are arranged as described above, then a single (same) color LED will be illuminated in each of the bulbs in each of the series blocks (i.e. all W LEDs or all M LEDs will be illuminated). With the switch positioned at B, full wave rectification is provided at rectifier terminals 56 and 58 in a second phase (opposite polarity of the first phase) and passed on to connection points 22 and 24. The second phase DC voltage is conducted through the LED light string across connectors 72 and 74 and all of the positively biased LEDs within each of the bulbs are illuminated. If the LEDs are arranged as described above, then a single (same) color LED will be illuminated in each of the bulbs in each of the series blocks, but the LEDs other than those illuminated with the first phase DC voltage applied (i.e. if the W LEDs were illuminated by the first phase DC voltage then the M LEDs will be illuminated by the second phase DC voltage and vice-versa). With the switch positioned at C, no rectification is provided and the input AC (or DC) power provided at male plug leads 32 and 34 is passed directly on to connection points 22 and 24. If the input power is AC then both sets of LEDs (W and M) will light alternately as biased by the appropriate phase of the AC power cycle. In essence, the AC input power simultaneously provides two different DC power components, having two different phases, to the LEDs so that both LEDs appear to illuminate simultaneously. In practical application, the "flicker" that is taking place electrically through the alternation of the phases is likely to be imperceptible to the human eye and the light string will have the appearance of having all the LEDs, W and M, on simultaneously. On the other hand, if the input power is DC with the switch in position C, then only one set of LEDs (W or M) will illuminate depending on the phase of the DC input as described above with respect to switch position A and B. Finally, with the switch positioned at D, no input power is provided to connection points 22 and 24 and all the LEDs remain off.

Switch position C can be termed the "follower" position particularly when the DC input to the LED light string system is provided by another (predecessor) LED light string system coupled to plug leads 32 and 34. In this arrangement of series-connected LED light string systems, LEDs (W or M) of the second light string system will follow those illuminated in the first light string system resulting in a uniform illumination color across all such "follower configured" LED light string systems. To aid with this coordination of color matching, polarity dots 21 and 91 are provided on controller 20 and female plug end 90 respectively. Thus, if the polarity dots of consecutively connected LED light string systems are matched at each plug interface and the switch setting of the second and all subsequent LED light string systems are at C, the same polarity will be maintained at the same terminals of each string and all the same color LEDs (W or M) will illuminate in unison throughout the entire plurality of light string systems according to the switch setting of the controller on the first LED light string system.

Those of skill in the art will appreciate that numerous convoluted lighting schemes may be achieved by switching controllers to different settings (i.e. not necessarily switching all follower LED light strings to a "following" position C) at different points in the series of connected LED light string systems.

Figure 2:
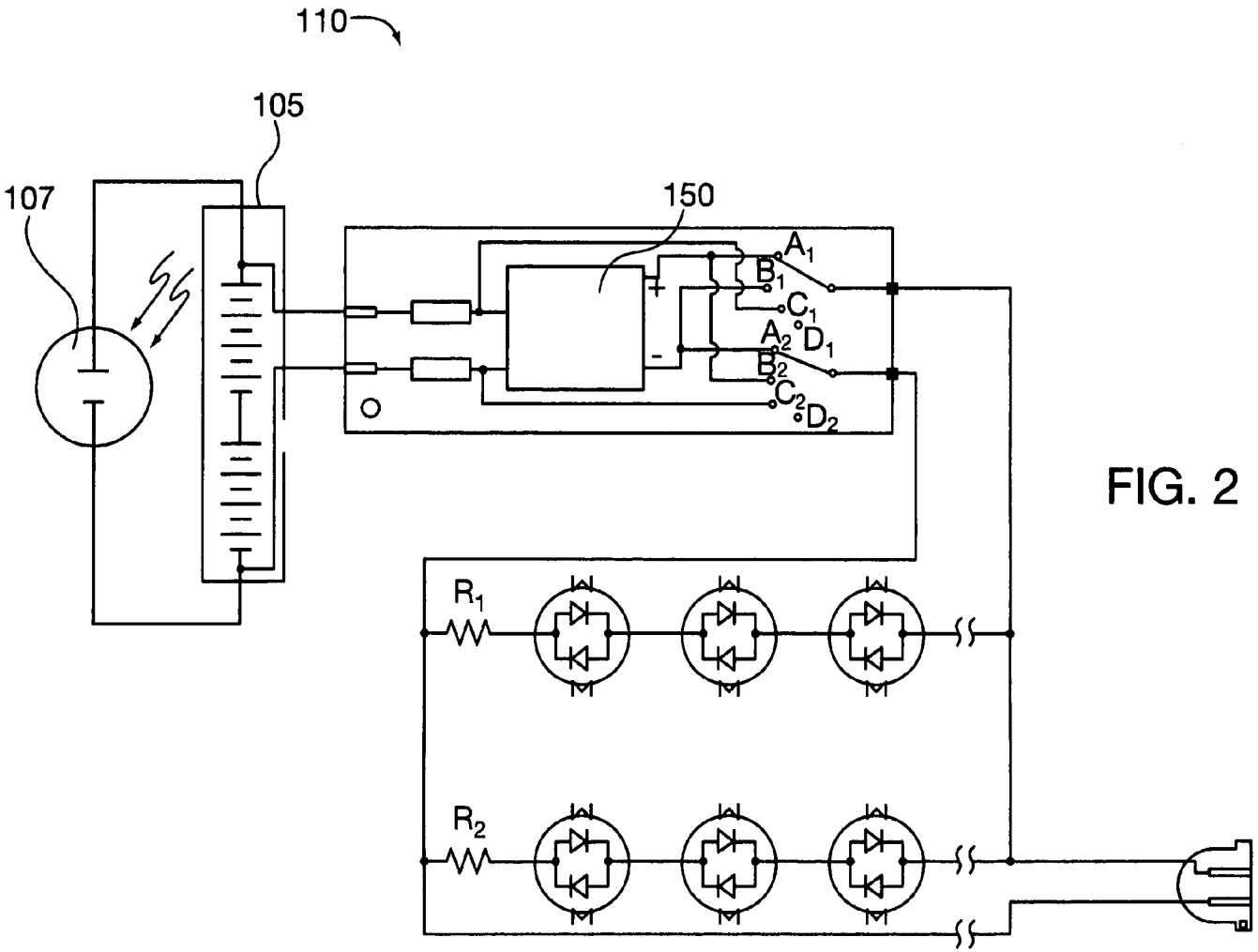
FIG. 2 is a circuit diagram of an LED light string system according to an alternative embodiment of the present invention.
Figure 3:
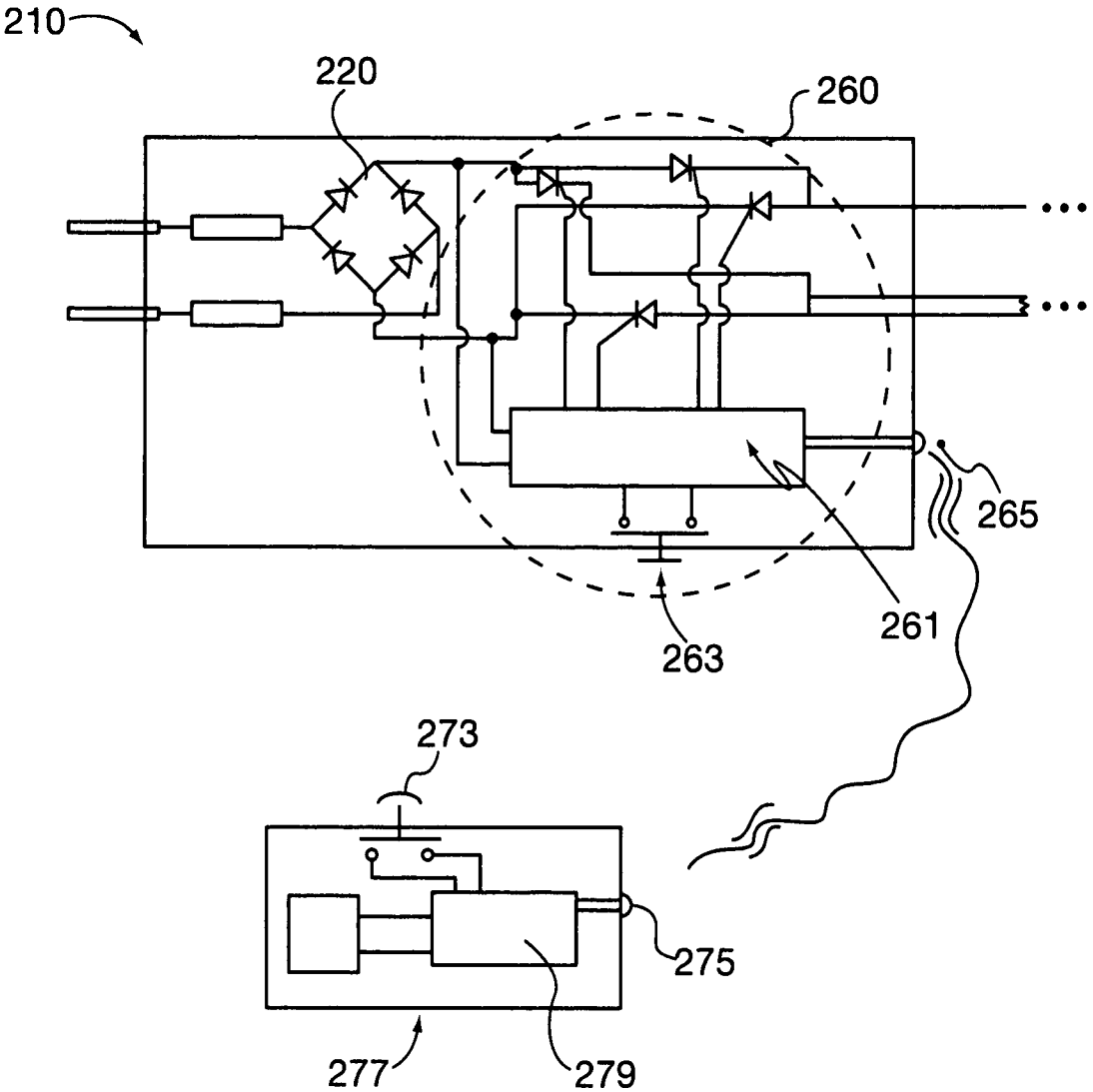
FIG. 3 is a diagram of a portion of an LED light string system according to an additional alternative embodiment of the present invention.
Figure 4:
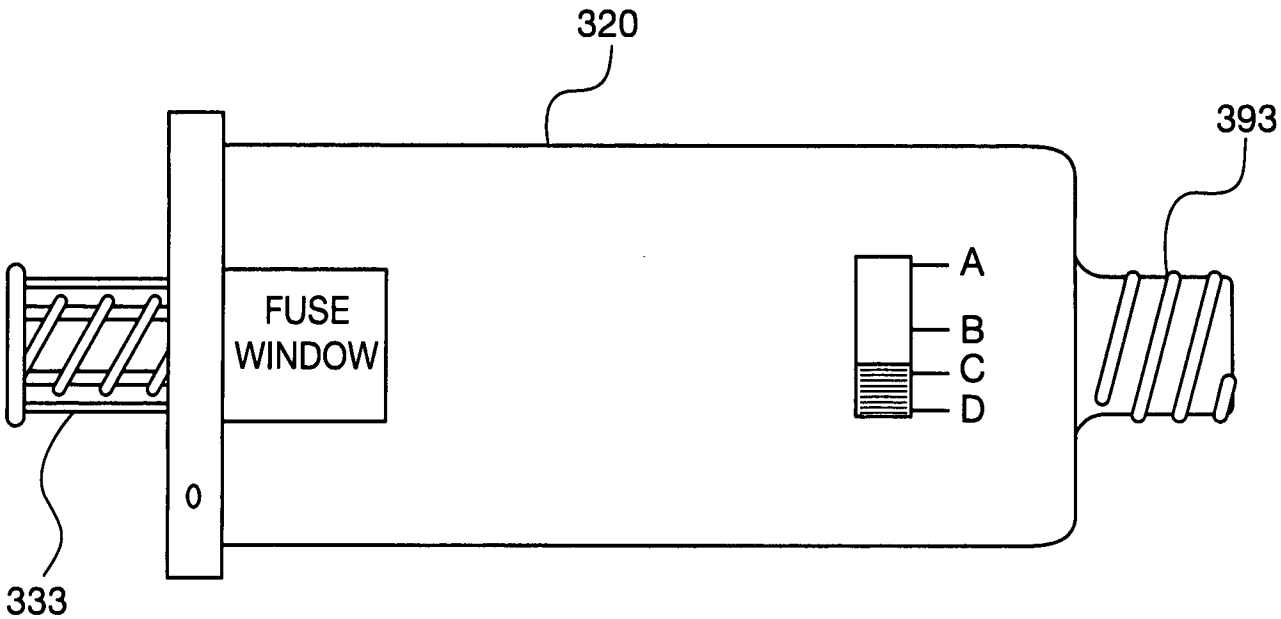
FIG. 4 is a side view of a separable controller for use with an LED light string system according to one embodiment of the present invention.

Although the physical construction and electrical circuit layout of FIG. 1 have been specifically disclosed, those of skill in the art will appreciate that alternative physical constructions and electrical arrangements may exist to accomplish the above-described functions without departing from the teaching of the present invention. Referring to FIG. 2, a low voltage AC/DC converter 150 may be substituted for the full-wave bridge rectifier 50. In one particularly preferred embodiment, a 12 or 24 volt DC output is provided by the low voltage AC/DC converter. Further, battery 105 may provide the input DC power for LED light string system 110 and the battery may be charged by optional solar cell 107. Referring to FIG. 3, four-position switch of controller 220 may be replaced with an integrated circuit 261 and associated circuitry (all within integrated circuit switch complex 260) wherein the integrated circuit is cycled through the four inputs with a push-button switch 263. Alternatively or in addition, remote control capability may be added for switching the controller. Wireless receiver/transmitter head 265 may be included in controller 220 for coordinating wireless communication with remote 277 having its own wireless receiver/transmitter head 275. Push-button switch 273 on the remote is used to switch among the controller switch positions in this embodiment and wireless signals exchanged between the receiver/transmitter heads 265 and 275 include switch position information and convey switch transition information for interpretation and execution by integrated circuit switch complex 260 and the wireless remote processor 279. Finally, the controller 20 may be removed from male plug leads 32 and 34 (which may be part of a typical AC male plug) and located at different positions within the LED light string cord. Alternatively, and referring to FIG. 4 the controller 320 may be an entirely separate component of the LED light string system for configurable connection to any one of a number of power inputs and LED light strings to be controlled. In one particularly preferred embodiment, the female plug end 90 is replaced by standardized connector 393 (shown as a screw-in connection in FIG. 4) that automatically maintains proper polarity alignment via a connector capable of only a single coupling orientation. A cap piece 333 may be provided so as to be mateably connected with the male plug ends to allow for chaining LED light string systems in series.

Figure 5:
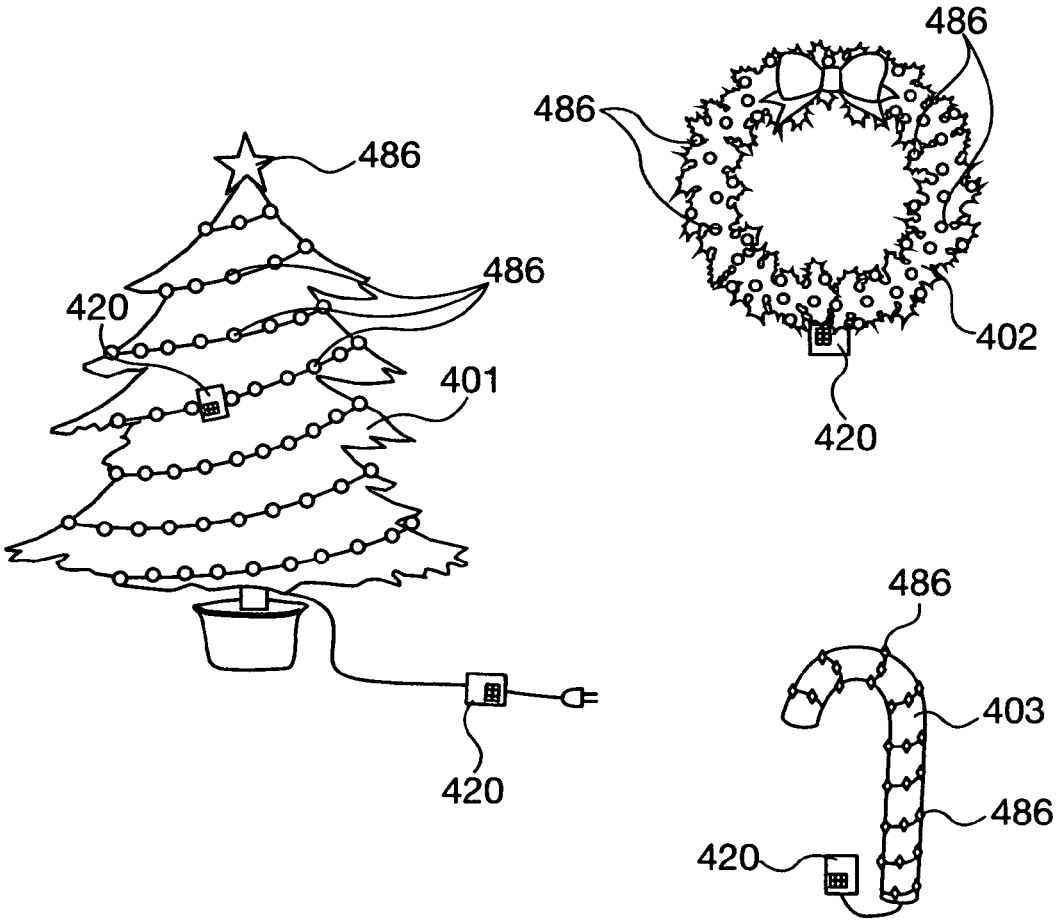
FIG. 5 provides a diagram illustrating a practical application of the LED light string system according to the teachings of the present invention.
Figure 6:
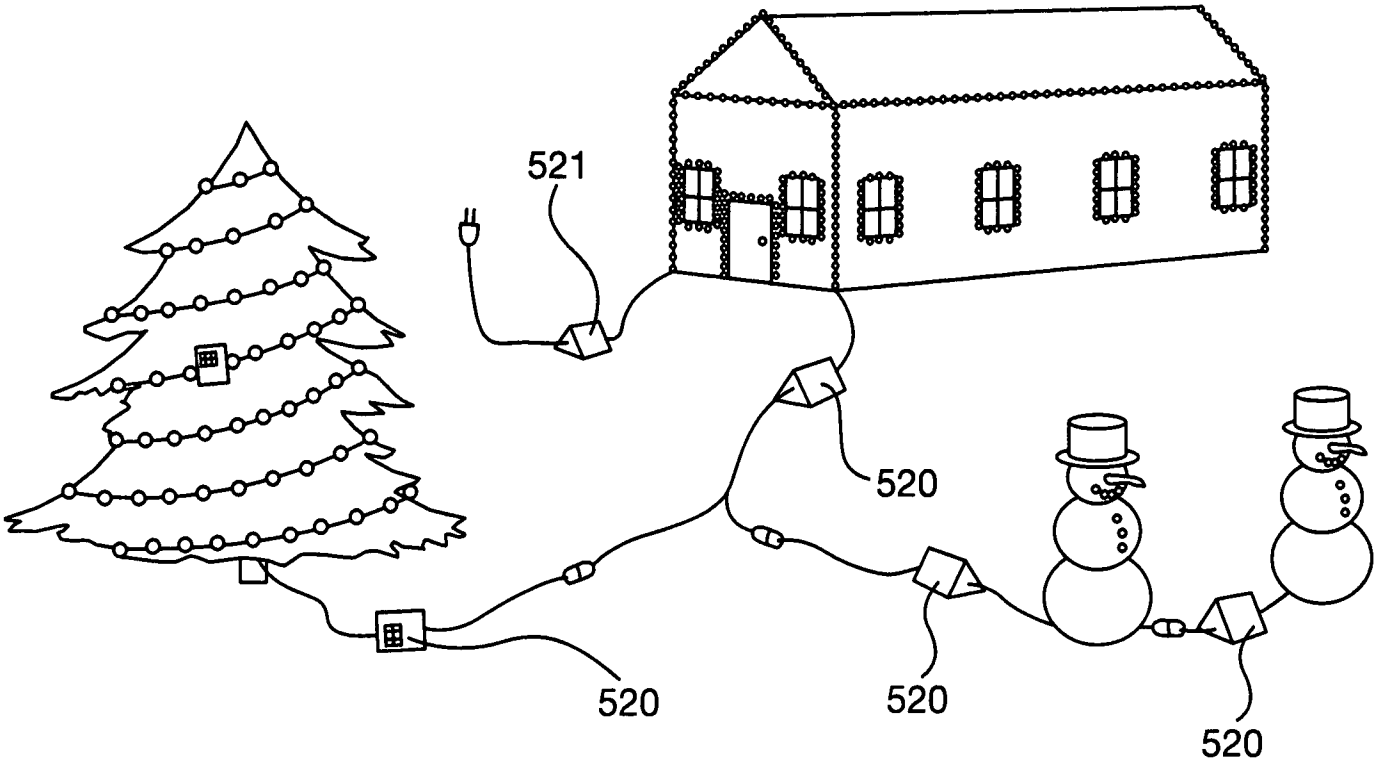
FIG. 6 provides another diagram illustrating a practical application of the LED light string system according to the teachings of the present invention.

In practical application, referring to FIG. 5, the LED light string systems of the present invention may be used on any type of holiday decorations, such as Christmas trees 401, wreaths 402, and other lighted holiday ornamentation 403. Each of these may require one or more LED light string systems to achieve the desired lighting effect. Dual color LED bulbs 486 controlled by controllers 420 may operate independent of each other as shown in FIG. 5, or they may be interconnected and properly switched at each controller to achieve a more coordinated effect as shown in FIG. 6. As shown there, a master controller 521 may be switched to setting A or B while all other controllers 520 may be switched to setting C to "follow" the polarity and presumably the color scheme selected by the master controller. All the "follower" LED light strings do not necessarily have to be of the same color or even a coordinated color depending on the desired lighting effect design, but interconnection of all the LED light strings ensures that "follower strings" have the capability of matching the LED color (through DC voltage phase pass through as selected by the master controller).

While the invention has been shown and described with reference to specific preferred embodiments, it should be understood by those skilled in the art that various changes in form and detail may be made therein without departing from the spirit and scope of the invention as defined by the following claims.

What is claimed is:

1. A lighting system comprising:

a light string, said light string having bulbs containing a first color LED and a second color LED, said LEDs within said bulbs electrically coupled so that a first voltage phase applied to said light string provides a turn-on bias to said first color LEDs within said bulbs and a second voltage phase applied to said light string provides a turn-on bias to said second color LEDs within said bulbs; and a controller electrically coupled to one end of said a light string, said controller having a rectifier for accepting an input electrical power source and providing an output DC electrical power to said light string, said controller having a switch with a plurality of switch positions including:

a first switch position for providing said output DC electrical power to said light string in said first voltage phase according to a first rectification provided by said rectifier within said controller, a second switch position for providing said output DC electrical power to said light string in said second voltage phase according to a second rectification provided by said rectifier within said controller, and a third switch position for providing said input electrical power source directly to said output DC electrical power and on to said light string.

2. The lighting system of claim 1 wherein said controller includes a fourth switch position that provides no output DC electrical power to said light string.

3. The lighting system of claim 1 wherein said rectifier is a low voltage AC-to-DC converter.

4. The lighting system of claim 1 wherein said rectifier is a full-wave bridge rectifier.

5. The lighting system of claim 1 wherein said input electrical power source is a DC power source.

6. The lighting system of claim 1 wherein a socket is connected to another end of said light string; said controller and said socket having indicators for identifying a polarity of said LED light string.

7. The lighting system of claim 1 wherein said lighting system includes a plurality of said light strings and coupled controllers; only one of said controllers having said switch in either of said first or said second switch positions; said other controllers having said switch in said third switch position.

8. A controller for controlling a LED light string, said controller comprising a rectifier for accepting an input electrical power source and providing an output DC electrical power to said LED light string, said controller having a switch with a plurality of switch positions including:

a first switch position for providing said output DC electrical power to said LED light string in a first voltage phase according to a first rectification provided by said rectifier within said controller, a second switch position for providing said output DC electrical power to said LED light string in a second voltage phase according to a second rectification provided by said rectifier within said controller, and a third switch position for providing said input electrical power source directly to said output DC electrical power and on to said LED light string.

9. The controller of claim 8 wherein said controller includes a standardized plug end for connection to said LED light string, said standardized plug end having only one coupling orientation.

10. A method of providing switched control to a lighting system comprising:

coupling a first and second controller to a first and second LED light string respectively, coupling said second controller to said first LED light string so that input power to said second controller is provided by said first LED light string;

switching said first controller to provide DC rectified power at a power output of said first light string, said DC rectified power derived from an input power source to said first controller and provided as said input power to said second controller; and switching said second controller to a pass through mode wherein said DC rectified power is provided directly to said second LED light string.

11. The method of claim 10 further comprising:

coupling a third controller to a third LED light string;

coupling said third controller to said second LED light string so that input power to said third controller is provided by said second LED light string; and switching said third controller to a pass through mode wherein said DC rectified power output of said second light string is provided directly to said third LED light string.

* * * * *